US007391150B2

(12) United States Patent
Nomura

(10) Patent No.: US 7,391,150 B2
(45) Date of Patent: Jun. 24, 2008

(54) ELECTRON-EMITTING DEVICE, ELECTRON SOURCE, IMAGE DISPLAY DEVICE AND INFORMATION DISPLAY AND REPRODUCTION APPARATUS USING IMAGE DISPLAY DEVICE, AND METHOD OF MANUFACTURING THE SAME

(75) Inventor: Kazushi Nomura, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 518 days.

(21) Appl. No.: 11/061,516

(22) Filed: Feb. 22, 2005

(65) Prior Publication Data

US 2005/0200266 A1 Sep. 15, 2005

(30) Foreign Application Priority Data

Mar. 10, 2004 (JP) ..... 2004-066555
Feb. 3, 2005 (JP) ..... 2005-027397

(51) Int. Cl.
*H01J 63/04* (2006.01)
*H01J 9/00* (2006.01)

(52) U.S. Cl. ..... 313/497; 445/24; 313/495

(58) Field of Classification Search ..... 313/495–497, 313/306; 445/24
See application file for complete search history.

(56) References Cited

U.S. PATENT DOCUMENTS 5,600,200 A * 2/1997 Kumar et al. ..... 313/346 R
6,008,502 A * 12/1999 Deguchi et al. ..... 257/10
6,313,815 B1 * 11/2001 Takeda et al. ..... 345/75.2
6,380,665 B1 4/2002 Motoi et al. ..... 313/310
6,853,126 B2 2/2005 Nomura ..... 313/492
6,888,296 B2 5/2005 Motoi et al. ..... 313/310
2002/0096986 A1 7/2002 Motoi et al. ..... 313/310
2005/0052108 A1 3/2005 Motoi et al. ..... 313/310

FOREIGN PATENT DOCUMENTS

JP 2-72534 3/1990
JP 02-220337 9/1990
JP 03-046729 2/1991
JP 05-047297 2/1993
JP 07-065697 3/1995
JP 08-250049 9/1996
JP 09-161659 6/1997
JP 11-317149 11/1999
JP 2000-285797 10/2000
JP 3154106 2/2001

* cited by examiner

*Primary Examiner*—Nimeshkumar D. Patel
*Assistant Examiner*—Anne M Hines
(74) *Attorney, Agent, or Firm*—Fitzpatrick, Cella, Harper & Scinto

(57) ABSTRACT

The present invention provide a lateral type electron-emitting device in which abnormal discharge near an electron-emitting region is suppressed, electron emission characteristics are stable, and electron emission efficiency is high. A method of manufacturing an electron-emitting device of the invention includes: a first step of preparing an electron-emitting electrode and a control electrode that are arranged on a surface of an insulating substrate; and a second step of covering the surface of the insulating substrate, which is located between the electron-emitting electrode and the control electrode, with a resistive film to connect the electron-emitting electrode and the control electrode. In the method of manufacturing an electron-emitting device, the resistive film is arranged to cover an end of a surface of the electron-emitting electrode opposed to the control electrode.

20 Claims, 10 Drawing Sheets

ELECTRON-EMITTING DEVICE, ELECTRON SOURCE, IMAGE DISPLAY DEVICE AND INFORMATION DISPLAY AND REPRODUCTION APPARATUS USING IMAGE DISPLAY DEVICE, AND METHOD OF MANUFACTURING THE SAME

BACKGROUND OF THE INVENTION

1. Field of the Invention

The present invention relates to a field emission electron-emitting device, an electron source and an image display device that use the electron-emitting device, and a method of manufacturing the same. In addition, the invention relates to an information displaying and reproducing apparatus using the image display device.

2. Related Background Art

As an electron-emitting device, there are a field emission (FE) electron-emitting device, a surface conduction electron-emitting device, and the like. The field emission electron-emitting device includes a metal/insulating layer/metal (MIM) electron-emitting device and a Spindt-type electron-emitting device.

An application of the electron-emitting device to an image display device has been examined by arranging plural electron-emitting devices on a substrate (see Japanese Patent No. 3154106, Japanese Patent Application Lai-Open No. H11-317149, and Japanese Patent Application Laid-Open No. H02-72534).

SUMMARY OF THE INVENTION

A flat panel display using an electron-emitting device is constituted by, in general, arranging a first substrate (a rear plate), on which plural electron-emitting devices are arranged, and a second substrate (a face plate), on which a light-emitting member such as a phosphor and an anode electrode including Al are stacked, to be opposed to each other and maintaining an opposed area in a vacuum. When electrons are emitted from plural electron-emitting devices, the flat panel display can typically form an image by applying a high voltage of 1 kV to 30 kV to the anode electrode so as to make the electrons collide against the anode. In the image display device that displays a desired image according to an input signal, it is necessary to electrically separate the electron-emitting devices (control each of the electron-emitting devices independently). Thus, in general, the first substrate is constituted of an insulator at least on a surface thereof. In addition, in general, the second substrate is constituted of a transparent substrate such as a glass substrate.

As a cause of instability of electron emission characteristics of the electron-emitting devices, there is instability of a potential on a surface of an insulating surface of the first substrate located near an electron-emitting region, which is caused by exposure of the insulating surface. The instability of a potential on the insulating surface is caused because a potential, due to capacity depending on a dielectric constant of an insulator and a vacuum, is generated on the insulating surface around the electron-emitting devices by a high voltage of 1 kV to 30 kV applied to the anode electrode. This potential has a longer time constant as insulating properties are higher, and the insulating surface is kept charged.

When electrons are emitted from the electron-emitting devices in this state, part of the emitted electrons collide against the insulating surface that has been charged. When charged particles such as electrons and ions are injected into the insulating surface, secondary electrons are generated. The generation of the secondary electrons results in abnormal discharge particularly under a high electric field. Thus, the electron emission characteristics of the electron-emitting devices deteriorate markedly and, in the worst case, the electron-emitting devices are destroyed.

This abnormal discharge phenomenon has not been fully clarified. However, it is conceivable that the abnormal discharge is caused by charging of the insulating surface due to injection of charged particles (such as electrons emitted from the electron-emitting devices and ions generated by the emitted electrons) into the insulating substrate or by avalanche effect of electrons due to emission of secondary electrons from the charged insulating surface.

In the case of a lateral type FE electron-emitting device, a cathode electrode and a gate electrode are arranged to be spaced apart from each other on an insulating surface (on same surface). When the lateral type FE electron-emitting device is driven, a voltage (potential) higher than that for the cathode electrode is applied to the gate electrode, whereby electrons are extracted from the cathode electrode. Thus, on a surface of the cathode electrode, a field intensity to be applied to an upper surface portion opposed to the anode electrode is lower than a field intensity to be applied to an end portion opposed to the gate electrode. The end portion can also refer to as "an opposed portion" or "a side surface". Therefore, the electrons to be emitted from the cathode electrode are mainly emitted from the end portion of the cathode electrode opposed to the gate electrode (the opposed portion of the cathode electrode against the gate electrode or the side surface of the cathode electrode opposed to the gate electrode) preferentially.

A trajectory of the electrons emitted from the end portion of the cathode electrode opposed to the gate electrode depends on parameters of a structure of the electron-emitting device (a distance between the cathode electrode and the gate electrode, a thickness of the cathode electrode, a thickness of the gate electrode, etc.) and drive conditions (a voltage to be applied to the anode electrode, a voltage to be applied to the gate electrode, etc.). However, a certain amount of the emitted electrons may collide against the gate electrode and/or the insulating surface, which is exposed between the cathode electrode and the gate electrode. As a result, the insulating surface exposed between the cathode electrode and the gate electrode is charged to make the electron emission characteristics of the electron-emitting device unstable. In addition, it is likely that the charged insulating surface leads to the aforementioned abnormal discharge. At this point, the electrons, which collide against the insulating surface and/or the gate electrode, are mainly emitted from an area, which is located closer to the insulating surface, of the end portion (the side surface) of the cathode electrode opposed to the gate electrode.

Therefore, in the case of the lateral type FE electron-emitting device, the abnormal discharge phenomenon is most likely to occur on the insulating surface that is exposed between the cathode electrode and the gate electrode. The abnormal discharge phenomenon is mainly caused by electrons emitted from the area, which is located closer to the insulating surface, of the end portion (the side surface) of the cathode electrode opposed to the gate electrode.

The present invention has been devised in order to solve or alleviate the problems, and it is an object of the invention to provide an electron-emitting device in which abnormal discharge near the electron-emitting device is avoided and electron emission characteristics are stable and a method of manufacturing the electron-emitting device. It is another object of the invention to provide an electron source and an image display device, an information display and a reproduction apparatus, which use the electron-emitting device, and a method of manufacturing the same.

In order to achieve the above objects, according to a first aspect of the present invention, there is provided a method of manufacturing an electron-emitting device that has an electron-emitting electrode and a control electrode arranged to be spaced apart from each other on an insulating substrate, and emits electrons from a surface of the electron-emitting electrode, including:

a first step of preparing the insulating substrate having the electron-emitting electrode and the control electrode on the surface thereof; and a second step of covering a surface of the insulating substrate, which is located between the electron-emitting electrode and the control electrode, with a resistive film, wherein in the second step, the resistive film is arranged to cover at least an end portion (side surface) of the surface of the electron-emitting electrode opposed to the control electrode.

According to a second aspect of the present invention, there is provided a method of manufacturing an electron-emitting device, wherein the electron-emitting electrode is formed by covering a conductive layer, which is stacked on the surface of the insulating substrate, and a surface other than a surface, which is in contact with the surface of the insulating substrate, with an insulating layer having a dipole layer on its surface.

According to a third aspect of the present invention, there is provided a method of manufacturing an image display device having an electron source and phosphors, wherein the electron source is manufactured by the manufacturing method according to the second aspect of the invention.

According to a fourth aspect of the present invention, there is provided an electron-emitting device having an electron-emitting electrode and a control electrode arranged to be spaced apart from each other on an insulating substrate, and emits electrons from a surface of the electron-emitting electrode, wherein a resistive film is arranged on a surface of the insulating substrate, which is located between the electron-emitting electrode and the control electrode, to connect the electron-emitting electrode and the control electrode, and the resistive film is arranged to cover at least an end (side surface) of the surface of the electron-emitting electrode opposed to the control electrode.

According to a fifth aspect of the present invention, there is provided an electron source having plural electron-emitting devices, wherein the electron-emitting devices are the electron-emitting device according to the fourth aspect of the present invention.

According to a sixth aspect of the present invention, there is provided an image display device having an electron source and a light-emitting member, wherein the electron source is the electron source according to the fifth aspect of the present invention.

As described above, the electron-emitting device of the invention is a lateral type FE electron-emitting device in which the resistive film is provided between the cathode electrode and the gate electrode as a film for suppressing charging. Thus, it is possible to suppress charged particles (such as electrons and ions) from being injected into the surface of the insulating substrate to generate secondary electrons and cause abnormal discharge under a high electric field and marked fall in electron emission characteristics of the electron-emitting device. In addition, since the end portion (the side surface) of the cathode electrode opposed to the gate electrode is also covered with the resistive film, it is possible to create a situation where electrons to be injected into the surface of the insulating substrate between the cathode electrode and the gate electrode are not emitted. Therefore, it is possible to obtain an electron-emitting device in which the abnormal discharge is less likely to occur and the electron emission characteristics are more stable.

When the electron-emitting device manufactured by the manufacturing method of the invention is applied to an electron source and an image display device, it is possible to realize an electron source and an image display device in which the abnormal discharge is less likely to occur and the electron emission characteristics are stable.

DESCRIPTION OF THE PREFERRED EMBODIMENTS

According to the electron-emitting device of the invention described above, since the insulating surface, which is located between the cathode electrode and the gate electrode, is covered with the resistive film, it is possible to suppress charging on the surface of the insulating substrate. In addition, since the end portion of the cathode electrode opposed to the gate electrode is also covered with the resistive film, it is possible to create a state in which electrons, which are a major factor in the charging of the insulating surface between the cathode electrode and the gate electrode, are not emitted. As a result, it is possible to obtain an electron-emitting device in which the electron emission characteristics are more stable and the abnormal discharge is less likely to occur.

Note that, in the invention, "the end portion of the cathode electrode opposed to the gate electrode" can also be refered to as "the side surface of the cathode electrode opposed to the gate electrode" or "the opposed portion of the cathode electrode against the gate electrode".

Exemplary embodiment modes of the present invention will be hereinafter explained in detail with reference to the accompanying drawings. Herein, dimensions, materials, shapes, and relative arrangements of components described in the embodiment modes are not meant to limit the scope of the invention thereto unless specifically noted otherwise.

An electron-emitting device of the invention is characterized in that a resistive film for suppressing a charging is provided between an electron-emitting electrode and a control electrode. Preferably the resistive film covers an end portion of a surface of the electron-emitting electrode opposed to the control electrode, whereby the resistive film also has a role of controlling an amount of electrons to be emitted from an end portion on the control electrode side of the electron-emitting electrode. Note that the "control of an amount of electrons to be emitted from the end portion of the electron-emitting electrode" includes a condition where electrons can not to be emitted from the end portion of the electron-emitting electrode.

Figure 1:
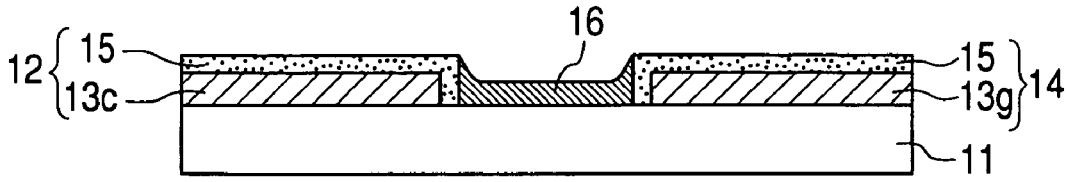
FIG. 1 is a schematic sectional view of an embodiment mode of an electron-emitting device of the invention.

FIG. 1 shows a schematic sectional view of a preferred embodiment mode of the electron-emitting device of the invention. In the figure, reference numeral 11 denotes a substrate; 12 denotes an electron-emitting electrode; 13*c* denotes a cathode electrode; 13*g* denotes a gate electrode; 14 denotes a control electrode; 15 denotes an insulating layer with a dipole layer arranged on a surface thereof; and 16 denotes a resistive film. Note that, in this example, "the electron-emitting electrode 12" includes the cathode electrode 13*c*, a dipole layer, and the insulating layer 15 with the dipole layer arranged on a surface thereof, and "the control electrode 14" includes the gate electrode 13*g*, the dipole layer, and the insulating layer 15 with a dipole layer arranged on a surface thereof.

An interval between the electron-emitting electrode 12 and the control electrode 14 and thicknesses, widths, and the like of materials forming the electron-emitting device are set to suitable values properly according to types and characteristics of the materials forming the electron-emitting device, a voltage at the time when the electron-emitting device is driven, a required shape of an emitted electron beam, and the like. The interval between the electron-emitting electrode 12 and the control electrode 14 is usually set in a range from several tens nm to several tens μm and, preferably, in a range of 100 nm to 10 μm.

FIG. 1 shows only the vicinity of an electron-emitting region. However, when the electron-emitting device of the invention is driven, as shown in FIG. 2, an anode 20, which attracts electrons emitted from the electron-emitting region, is arranged to be opposed to the electron-emitting region.

In an example explained here, "an electron-emitting electrode" includes a cathode electrode, an insulating layer covering a surface of the cathode electrode, and a dipole layer arranged on a surface of the insulating layer. However, in the electron-emitting device of the invention, a structure of "the electron-emitting electrode" is not limited to this structure. For example, the invention is preferably applicable to "an electron-emitting electrode" that includes an electrode and a layer consisting of an electron-emitting material covering the electrode. Such a layer consisting of an electron-emitting material may be, for example, a diamond layer with a low work function, a conductive layer including a graphite component and an amorphous carbon component, a layer containing a large number of fine graphite particles (e.g., graphite particles in an order of nano-scale to an order of micron-scale), or the like. Note that the graphite particles include particles having spherical graphite, polygonal graphite, fullerene, and cylindrical graphen. However, to express effects of the invention noticeably, it is preferable that an electron-emitting electrode (an electron-emitting member) be constituted such that emission of electrons from the electron-emitting electrode can be realized under a state in which, effectively, an electric field intensity lower than $1\times10^6$ V/cm is applied between the electron-emitting electrode and the control electrode. In addition, in the example explained here, "the control electrode" has the same structure as "the electron-emitting electrode". However, basically, "the control electrode" may have any structure as long as "the control electrode" can control a potential for controlling emission of electrons from "the electron-emitting electrode" (a potential for extracting electrons, stopping emission of electrons, and controlling an amount of emission of electrons) easily. For example, it is also possible to constitute "the control electrode" with only a metal electrode.

Figure 2:
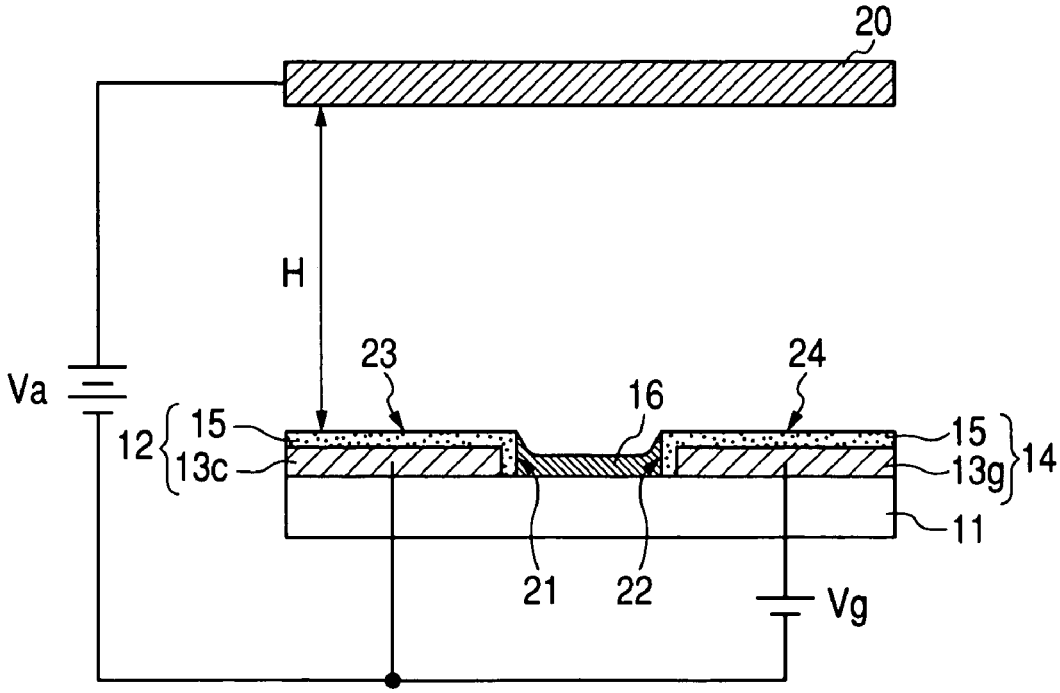
FIG. 2 is a schematic sectional view showing an example of a structure of the electron-emitting device shown in FIG. 1 being operated.

In the schematic sectional views of the electron-emitting device of the invention shown in FIGS. 1 and 2, ends of the electrode-emitting electrode 12, the cathode electrode 13*c*, the gate electrode 13*g*, and the control electrode 14 are formed substantially perpendicularly to a surface of the substrate 11. However, the electron-emitting device of the invention is not limited to such a shape of the ends. In other words, an end portion of the cathode electrode 13*c* on the gate electrode 13*g* side may be formed into a shape that is not perpendicular to the surface of the substrate 11 (e.g., a tapered shape or an arc shape). Similarly, an end portion of the gate electrode 13*g* on the cathode electrode 13*c* side may be formed into a shape that is not perpendicular to the surface of the substrate 11 (e.g., a tapered shape or an arc shape). When the end portion is formed in the tapered shape, it is preferable that a thickness of the cathode electrode 13*c* (the gate electrode 13*g*) decrease toward the gate electrode 13*g* (the cathode electrode 13*c*) side. If such a form is adopted, it is possible to increase an amount of electrons that reach the anode 20.

An example of a method of manufacturing the electron-emitting device of the invention shown in FIG. 1 will be hereinafter explained with reference to FIGS. 3A to 3E. Note that FIGS. 3A to 3E are schematic sectional views in respective manufacturing steps.

(Step 1)

Figure 3A:
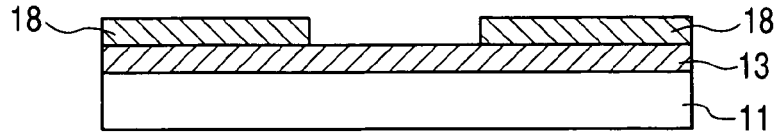
FIGS. 3A, 3B, 3C, 3D and 3E are process diagrams showing an example of a method of manufacturing the electron-emitting device of FIG. 1.

First, a conductive layer 13 is stacked on the insulating substrate 11, a surface of which is sufficiently cleaned, in advance. Thereafter, a mask pattern 18 is formed by a photolithographic technique (FIG. 3A). The mask pattern 18 is formed excluding a portion equivalent to an interval between the cathode electrode 13*c* and the gate electrode 13*g* that are formed in later steps (a portion to be etched). Note that the insulating substrate 11 in the invention may be any substrate as long as a resistance value between the cathode electrode 13*c* and the gate electrode 13*g* is higher than that of the resistive film 16 to be described later. Typical examples that can be used as the insulating substrate 11 include a glass substrate of quartz glass, glass with a reduced alkali component, or the like.

The insulating substrate 11 is selected properly out of insulating substrates of quartz glass, glass with a reduced content of impurities such as Na, soda lime glass, a layered product obtained by stacking $SiO_2$ on a silicon substrate by a sputtering method or the like, and ceramics such as alumina.

The conductive layer 13 is formed by a general vacuum film formation technique such as an evaporation method or a sputtering method. A material for the conductive layer 13 is selected properly out of, for example, metal or alloy materials of Be, Mg, Ti, Zr, Hf, V, Nb, Ta, Mo, W, Al, Cu, Ni, Cr, Au, Pt, and Pd, carbides such as Tic, ZrC, HfC, TaC, SiC, and WC, borides such as $HfB_2$, $ZrB_2$, $LaB_6$, $CeB_6$, $YB_4$, and $GdB_4$, nitrides such as TiN, ZrN, and HfN, semiconductors such as Si and Ge, and the like. A thickness of the conductive layer 13 is set in a range from several tens nm to several tens μm and, preferably, in a range of several tens nm to several μm.

(Step 2)

Figure 3B:
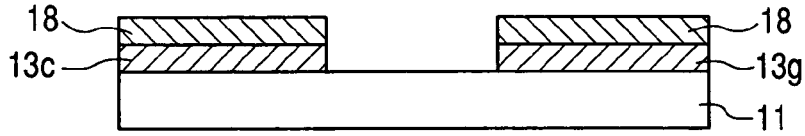

Next, the conductive layer 13 is separated to form the cathode electrode 13*c* and the gate electrode 13*g* (FIG. 3B). Formation of a space between the cathode electrode 13*c* and the gate electrode 13*g* is performed by etching. An etching step may be performed until the insulating substrate 11 is slightly shaved. An etching method has only to be selected according to the conductive layer 13 that is an object of etching.

(Step 3)

Figure 3C:
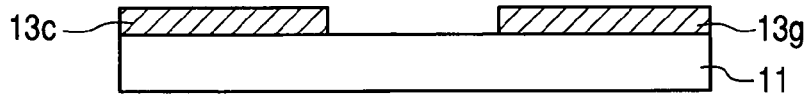

The mask pattern 18 is removed (FIG. 3C).

(Step 4)

Figure 3D:
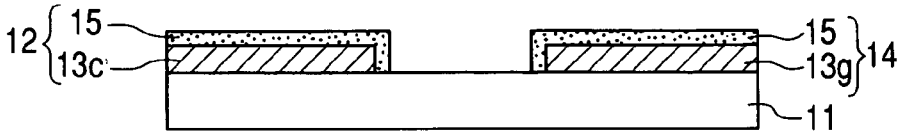

Subsequently, the insulating layer 15 with a dipole layer arranged on a surface thereof is deposited (FIG. 3D).

Note that the insulating layer 15 with a dipole layer arranged on a surface thereof can be formed on the cathode electrode 13*c* and the gate electrode 13*g* by, for example, heating the insulating substrate 11 that has undergone steps 1 to 3 in the atmosphere containing carbon and hydrogen. The atmosphere containing carbon and hydrogen is, for example, the atmosphere containing a hydrocarbon gas or the atmosphere containing a hydrocarbon gas and a hydrogen gas. Preferably used as the hydrocarbon gas is a chain hydrocarbon gas such as an acetylene gas, an ethylene gas, or a methane gas.

"The insulating layer" in the expression "the insulating layer 15 with a dipole layer arranged on a surface thereof" is, preferably, an insulator comprising a carbide that is formed with carbon as a main component, an insulator comprising carbon, or a high resistor substantially recognized as an insulator. For example, the insulator or the high resistor may contains diamond-like carbon, diamond, amorphous carbon, or the like as a main component. In addition, "the dipole" in the expression "the insulating layer 15 with a dipole layer arranged on a surface thereof" is a dipole that is generated between a terminated molecule or terminated atom of a surface of an insulating layer and a molecule or an atom terminating the molecule or the atom. It is preferable that the molecule or the atom terminating the molecule or the atom of the surface of the insulating layer be a hydrogen atom and/or a molecule containing a hydrogen atom.

Figure 3E:
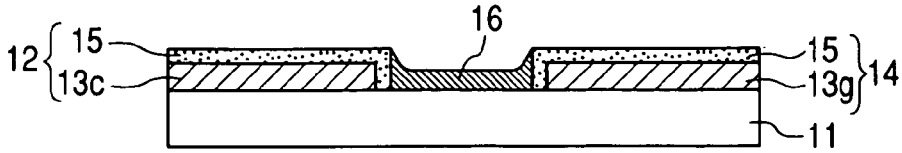
Figure 4A:
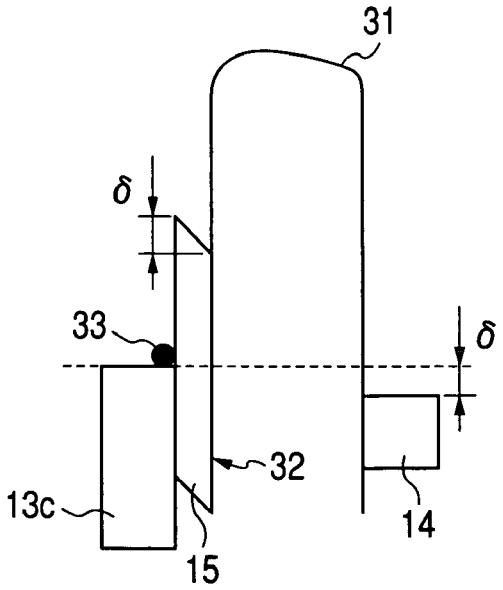
FIGS. 4A and 4B are band diagrams for explaining an electron emission principle in the electron-emitting device of the invention.
Figure 4B:
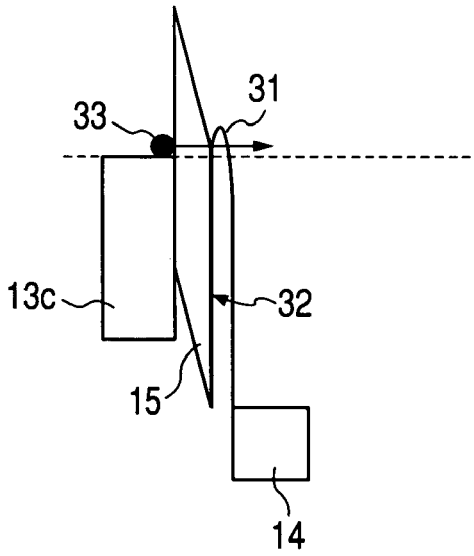

A principle of emission of electrons from the electron-emitting electrode 12 will be explained with reference to band diagrams shown in FIGS. 4A and 4B. In FIGS. 4A and 4B, reference numeral 31 denotes a vacuum barrier; 32 denotes an interface between the insulating layer 15 with a dipole layer arranged on a surface thereof and a vacuum; and 33 denotes an electron. Members the same as those in FIGS. 1 to 3 are denoted by the same reference numerals.

Note that a drive voltage for extracting electrons from the electron-emitting electrodes 12 into the vacuum is equivalent to a voltage between the cathode electrode 13*c* and the gate electrode 13*g* in a state in which a potential higher than a potential for the cathode electrode 13*c*, is applied to the gate electrode 13*g*.

FIG. 4A is a band diagram at the time when the drive voltage (the voltage between the cathode electrode 13*c* and the gate electrode 13*g*) is 0 [V] in the electron-emitting device using the electron-emitting electrode. FIG. 4B is a band diagram at the time when a drive voltage V [V] necessary for emission of electrons is applied to the electron-emitting device. In FIG. 4A, the insulating layer 15 is polarized by the dipole layer formed on the surface thereof and is in a state in which a voltage of δ is being applied thereto. In this state, when the drive voltage V [V] is applied to the insulating layer 15, a band of the insulating layer 15 bends more steeply and, at the same time, the vacuum barrier 31 also bends more steeply. In this state, the vacuum barrier 31, which is in contact with the dipole layer, is higher than a conduction band on the surface of the insulating layer 15 (see FIG. 4B). In the state, the electron 33 injected from the cathode electrode 13*c* can tunnel through the insulating layer 15 and the vacuum barrier 31 to be emitted to the vacuum. Note that the drive voltage V [V] in the electron-emitting device using the electron-emitting electrode is preferably 50 [V] or less and, more preferably, 5 [V] or more and 50 [V] or less.

Figure 5:
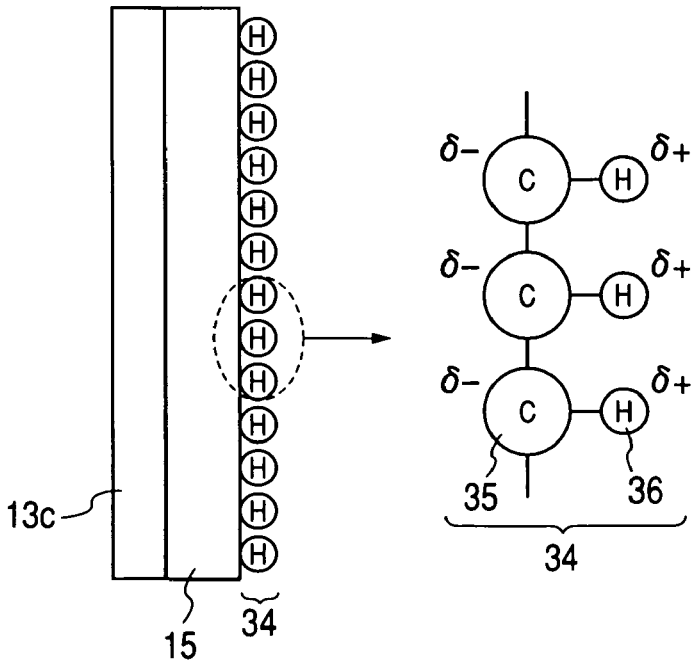
FIG. 5 is an enlarged schematic diagram of a surface of an electron-emitting electrode in the electron-emitting device of the invention.

The state in FIG. 4A will be explained with reference to FIG. 5. A figure on the right side in FIG. 5 is a schematic diagram showing an area encircled by a dotted line in a figure on the left side in enlargement. In the figure, reference numeral 34 denotes a dipole layer; 35 denotes carbon atoms; and 36 denotes hydrogen atoms. Note that, in this case, carbon atom or a carbon compound, which is constituting the surface of the insulating layer (the interface with the vacuum), is terminated by the hydrogen 36 as the dipole layer 34. However, a material forming the dipole layer 34 (terminating material) in the invention is not limited to the hydrogen 36. The material terminating the surface of the insulating layer 15 may be any material as long as the material lowers a surface level of the insulating layer 15 in a state in which a voltage is not applied between the cathode electrode 13*c* and the gate electrode 13*g*. However, preferably, hydrogen is used. In addition, it is preferable that the material terminating the surface of the insulating layer 15 be a material that lowers the surface level of the insulating layer 15 by 0.5 eV or more, preferably, 1 eV or more in a state in which a voltage is not applied between the cathode electrode 13*c* and the gate electrode 13*g*. However, in the electron-emitting device using the electron-emitting electrode, the surface level (surface energy level) of the insulating layer 15 is required to show a positive electron affinity at both the time when a drive voltage is applied between the cathode electrode 13*c* and the gate electrode 13*g* and the time when a drive voltage is not applied (when a potentials of the cathode and gate electrodes are substantially same).

A thickness of the insulating layer 15 can be determined based on a drive voltage. However, preferably, the thickness is set to 20 nm or less and, more preferably, 10 nm or less. As a lower limit of the thickness of the insulating layer 15 may be any thickness as long as a barrier (the insulating layer 15 and the vacuum barrier), through which the electron 33 supplied from the cathode electrode 13*c* is to tunnel, is formed at the time of driving. However, from the viewpoint of reproducibility of film formation or the like, preferably, the thickness of the insulating layer 15 is set to 1 nm or more.

In an electron-emitting device that uses a semiconductor having a negative electron affinity or a semiconductor having an extremely small positive electron affinity, when an electron is injected into the semiconductor, the electron is almost always emitted. Therefore, when this characteristic of emitting an electron easily is applied to a display, an electron source, or the like, it may be extremely difficult to control an amount of emission of electrons from each electron-emitting device (in particular, switching of ON and OFF). However, in the electron-emitting device of the invention described above, since the insulating layer 15 always shows a positive electron affinity, it is possible to provide an electron-emitting device that shows a sufficient ON/OFF characteristic and is capable of emitting electrons with high efficiency at a low drive voltage.

In the example of FIG. 5, as the dipole layer 34, the surface of the insulating layer 15 is terminated by the hydrogen 36. In general, the hydrogen atoms 36 are polarized slightly to positive ($\delta^+$). Consequently, atoms (in this case, the carbon atoms 35) on the surface of the insulating layer 15 are polarized slightly to negative ($\delta^-$) to form the dipole layer (which can also be referred to as "an electric double layer") 34.

Thus, as shown in FIG. 4A, despite the fact that a drive voltage is not applied between the cathode electrode 13*c* and the gate electrode 13*g*, a state, which is equivalent to a state in which a potential δ [V] of an electric double layer is applied, is formed on the surface of the insulating layer 15. In addition, as shown in FIG. 4B, the fall of the surface level of the insulating layer 15 progresses according to the application of the drive voltage V [V] and, in association with this, the vacuum barrier 31 is also lowered. In the invention, the film thickness of the insulating layer 15 is properly set to a film thickness that allows electrons to tunnel through the insulating layer 15 with the drive voltage V [V]. However, taking into account a load on a drive circuit or the like, it is preferable to set the thickness to 10 nm or less. When the film thickness is about 10 nm, it is possible to reduce a spatial distance, in which the electron 33 supplied from the cathode electrode 13*c* passes through the insulating layer 15, according to the application of the drive voltage V [V]. As a result, the insulating layer 15 can be tunneled through.

As described above, the vacuum barrier 31 is also lowered in association with the application of the drive voltage V [V] and the spatial distance thereof is reduced in the same manner as the insulating layer 15. Thus, since the vacuum barrier 31 can also be tunneled through, emission of electrons to the vacuum is realized.

(Step 5)

Next, a part of the insulating surface, which is the portion exposed between the electron-emitting electrode 12 and the control electrode 14, is covered with the resistive film 16. At this point, the resistive film 16 is preferably formed to be connected to the electron-emitting electrode 12 and the control electrode 14 (FIG. 3E).

The resistive film 16 may be formed by any method as long as the resistive film 16 can be arranged in a desired area. For example, it is possible to form the resistive film 16 using a general vacuum film formation technique such as a CVD method, an evaporation method, a sputtering method, or a plasma method by masking portions other than a portion where the resistive film 16 is arranged. Alternatively, it is also possible to arrange the resistive film 16 only in a portion where it is desired to arrange the resistive film 16 by using a printing method of an ink jet system or the like. It is convenient and preferable to use the printing method of the ink jet system because a patterning process can be omitted.

It is preferable that the resistive film 16 be made of a material from which a film, which is uniform in a large area, is obtained easily. For example, it is possible to form the resistive film 16 from a carbon material, a metal oxide such as tin oxide or chrome oxide, or a material obtained by dispersing a conductive material in an inuslating material such as silicon oxide. The resistive film 16 has a work function higher than an effective work function of the electron-emitting electrode 12 (typically, an effective work function of the surface of the electron-emitting electrode 12).

It is desirable that a leak current caused by the resistive film 16 between the electron-emitting electrode 12 and the control electrode 14 be substantially negligibly small. In order to suppress abnormal discharge, it is preferable that a sheet resistance value of the resistive film 16 is $10^{12}$ Ω/□ or less. A film thickness of the resistive film 16 is set in a range of several nm to several hundreds nm and may be larger or smaller than thicknesses of the electron-emitting electrode 12 and the control electrode 14.

In the present invention, in addition to the arrangement form described above, the resistive film 16 may include further modifications. Thus, preferred examples of an arrangement form of the resistive film 16 in the invention will be hereinafter explained with reference to FIGS. 1, 2, and 6A to 6D.

(First example of an arrangement form: covering of an end)

As a first example of an arrangement form, in addition to the surface of the insulating substrate exposed between the electron-emitting electrode 12 and the control electrode 14, an end portion 21, which is in the surface of the electron-emitting electrode 12 and opposed to the control electrode 14 (and/or an end portion 22, which is in the surface of the control electrode 14 and opposed to the electron-emitting electrode 12), is covered with the resistive film 16. Note that, in the invention, "an end portion of a control electrode opposed to an electron-emitting electrode" can also be expressed as "a side surface of a control electrode opposed to an electron-emitting electrode" or "an opposed portion of a control electrode against an electron-emitting electrode".

The end portions 21 and 22 of the electron-emitting electrode 12 and the control electrode 14 may be partially covered with the resistive film 16 rather than being entirely covered. In that case, it is desirable that the resistive film 16 cover a portion closer to the substrate 11. It is possible to separate an emission point of electrons from the surface of the substrate by covering the end portion 21, which is in the surface of the electron-emitting electrode 12 and opposed to the control electrode 14, with the resistive film 16. As a result, it is possible to reduce a current (an ineffective current) flowing to the control electrode 14. In addition, it is possible to reduce a range of an anode that is irradiated by the emitted electrons. Further it is possible to electrically connect the electron-emitting electrode 12 and the resistive film 16 satisfactorily by covering the end portion 21 of the electron-emitting electrode 12 with the resistive film 16. As a result, it is possible to stabilize emission of electrons. It is considered that this is because a potential changed by irradiation of electrons and ions on a part of the resistive film 16 can be neutralized or remodved promptly.

Figure 6A:
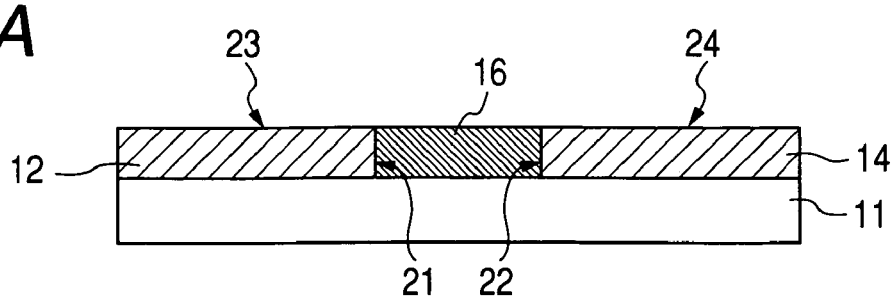
FIGS. 6A, 6B, 6C and 6D are schematic sectional views showing an arrangement form of a resistive film according to the invention.

In order to minimize emission of electrons from the end portion 21 of the electron-emitting electrode 12 opposed to the control electrode 14, as schematically shown in FIGS. 1 and 2, it is preferable to entirely cover the end portion 21, which is in the surface of the electron-emitting electrode 12 and opposed to the control electrode 14, with the resistive film 16. Therefore, as a structure for attaining the effect easily, it is preferable to entirely cover the end portions 21 and 22 of the electron-emitting electrode 12 and the control electrode 14 with the resistive film 16. Typically, as shown in FIG. 6A, it is possible to form this structure by filling a gap between the electron-emitting electrode 12 and the control electrode 14 with the resistive film 16.

(Second example of an arrangement form: covering of an upper surface portion)

Figure 6B:
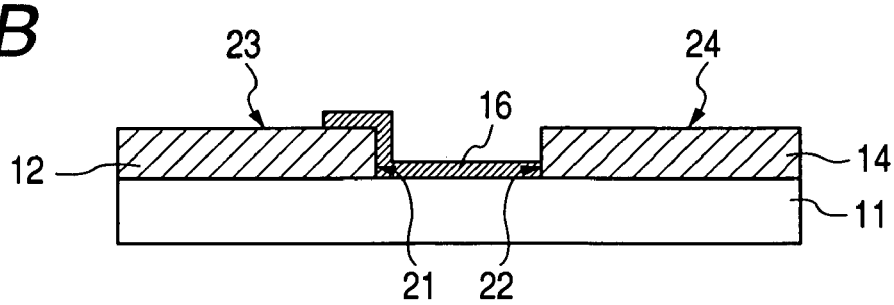
Figure 6C:
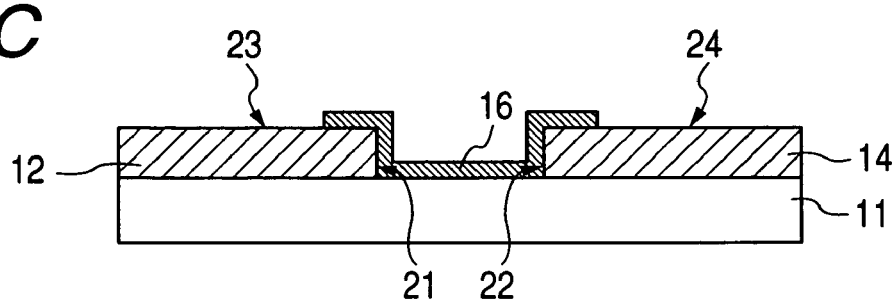
Figure 6D:
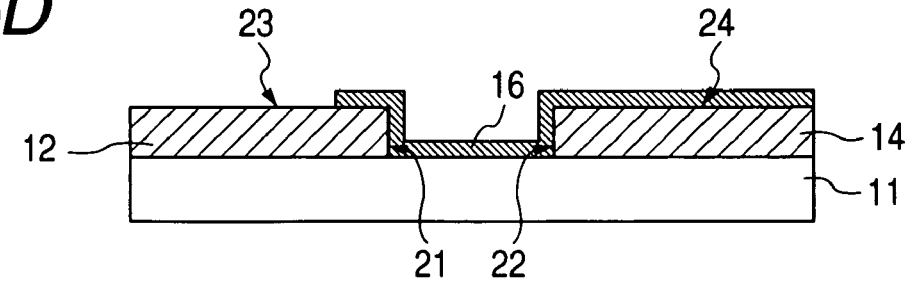

As a second example of an arrangement form, in addition to the first example of an arrangement form, at least a part of an upper surface portion 23 of the electron-emitting electrode 12 and/or an upper surface portion 24 of the control electrode 14 opposed to the anode electrode 20 (see FIG. 2) is covered (FIGS. 6B, 6C, and 6D).

It is preferable to cover the upper surface portion 23 of the electron-emitting electrode 12, which is an upper surface portion on the control electrode 14 side, with the resistive film 16 (see FIG. 6B). With this structure, electrons are emitted preferentially from the upper surface portion 23 of the electron-emitting electrode 12 that is an area not covered with the resistive film 16 and closer to the control electrode 14. As a result, it is possible to eliminate emission of electrons from the vicinity of the end portion 21 of the electron-emitting electrode 12. In addition, since a component heading toward an anode of emitted electrons is intensified, it is possible to further reduce a range of an anode irradiated by the emitted electrons.

It is preferable to cover the upper surface portion 24 of the control electrode 14, which is an upper surface portion on the electron-emitting electrode 12 side, with the resistive film 16 (see FIGS. 6C and 6D). With this structure, for example, in the case in which an electron source to be described later is driven, it is possible to prevent an electron emission from the control electrode 14 of unselected electron-emitting device when an inverse voltage relative to a driving voltage is applied to the unselected electron-emitting device. In particular, in the manufacturing method of steps 1 to 4 described above, since the structure of the control electrode 14 is the same as the electron-emitting electrode 12, electrons tend to be emitted when the voltage of the opposite polarity is applied. In particular, in the case in which electrons are emitted with a low field intensity of $1\times10^6$ V/cm or less as described above, it is preferable as shown in FIG. 6D to entirely cover the upper surface portion 24 of the control electrode 14 opposed to the anode electrode (or the upper surface portion 24 of the control electrode 14 opposed to the anode electrode in a range to which a field intensity allowing electrons to be emitted is likely to be applied) with the resistive film 16. Therefore, in the form shown in FIG. 6D, an area of the resistive film 16 covering the surface of the control electrode 14 is set to be larger than an area of the resistive film 16 covering the surface of the electron-emitting electrode 12.

Note that, it is preferable that the resistive film 16 is a continuous film that continuously covers the electron-emitting electrode 12, the control electrode 14, and the surface of the substrate between the electron-emitting electrode 12 and the control electrode 14.

Next, an example of application, to which an electron-emitting device manufactured by the manufacturing method described above is applied, will be hereinafter described. It is possible to constitute, for example, an electron source or an image display device by arranging plural electron-emitting devices, which are manufactured by the method of manufacturing an electron-emitting device according to this embodiment mode, on an identical surface of a substrate.

An electron source, which is obtained by arranging plural electron-emitting devices manufactured by the method of manufacturing an electron-emitting device of the invention, will be explained with reference to FIG. 7.

Figure 7:
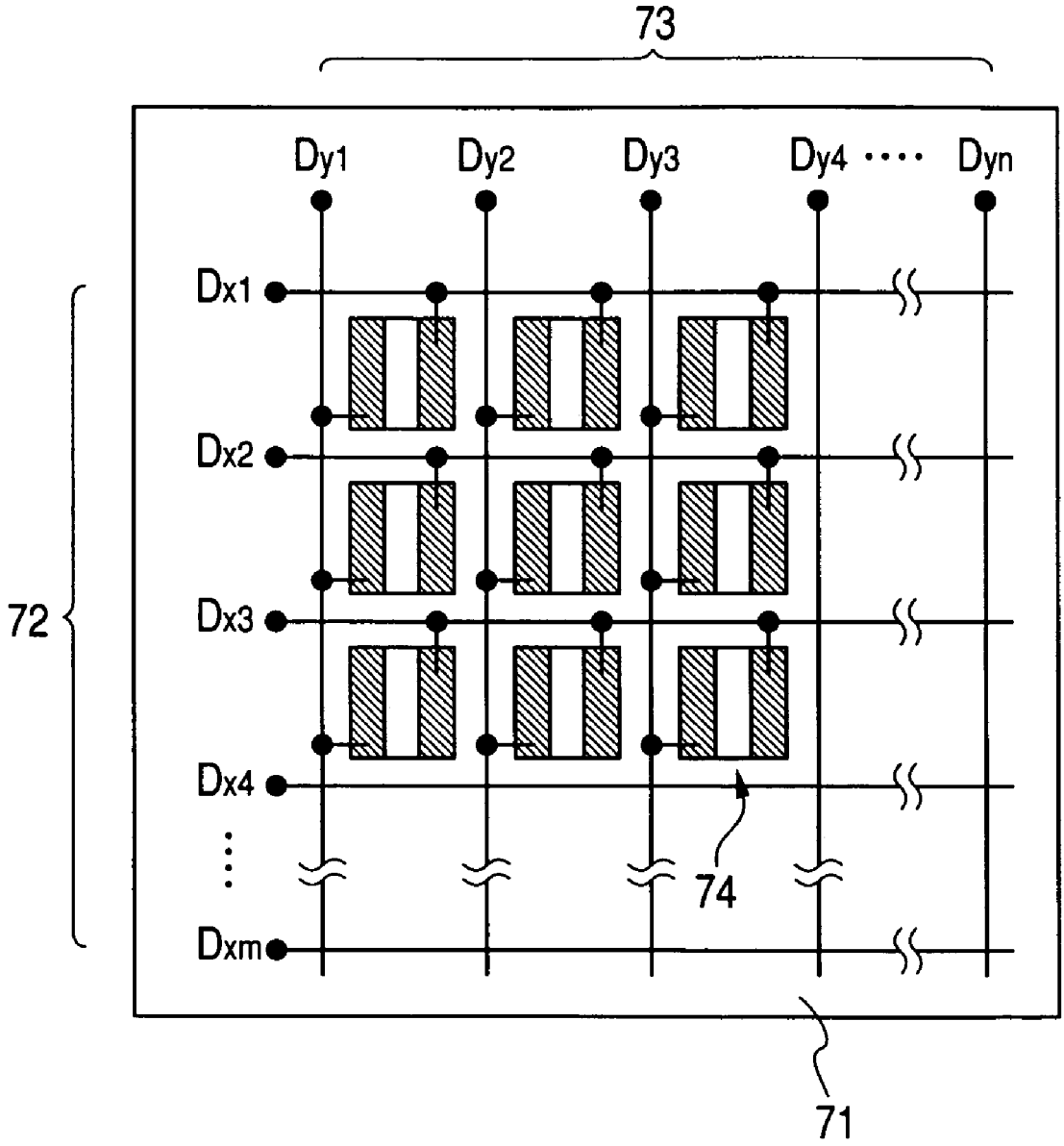
FIG. 7 is a schematic diagram of an embodiment mode of an electron source of the invention.

In FIG. 7, reference numeral 71 denotes an electron source substrate; 72 denotes X directional wirings; 73 denotes Y directional wirings; and 74 denotes electron-emitting devices of the invention.

The X directional wirings 72 comprises m wirings, Dx1, Dx2, . . . Dxm. The X directional wirings 72 can be formed using a vacuum evaporation method, a printing method, a sputtering method, or the like and can be formed of metal or the like. A material, a thickness, and a width of the wirings are designed properly. The Y directional wirings 73 comprises n wirings, Dy1, Dy2, . . . Dyn, and are formed in the same manner as the X directional wirings 72. An inter-layer insulating layer (not shown) is provided between the X directional wirings 72 and the Y directional wirings 73 and separates one from the other. Here, both m and n are positive integers. The inter-layer insulating layer (not shown) is formed of $SiO_2$ or the like that is formed using the vacuum evaporation method, the printing method, or the sputtering method. A part of the X directional wirings 72 and the Y directional wirings 73 are drawn out as external terminals, respectively.

Each pairs of electrodes (the electron-emitting electrodes 12 and the control electrodes 14) constituting the electron-emitting devices 74 are electrically connected to one of the X directional wirings 72 and one of the Y directional wirings 73.

Scanning signal applying means (not shown), which applies a scanning signal to the X directional wirings 72, is connected to the X directional wirings 72. On the other hand, modulation signal applying means (not shown) for modulating a discharged current from each electron-emitting device is connected to the Y directional wirings 73. A drive voltage to be applied to each of the electron-emitting devices 74 is supplied as a difference voltage of the scanning signal and the modulation signal to be applied to the electron-emitting device 74.

In the structure described above, it is possible to select the individual electron-emitting device 74 and drive the electron-emitting device 74 independently using a simple matrix wiring.

Figure 8:
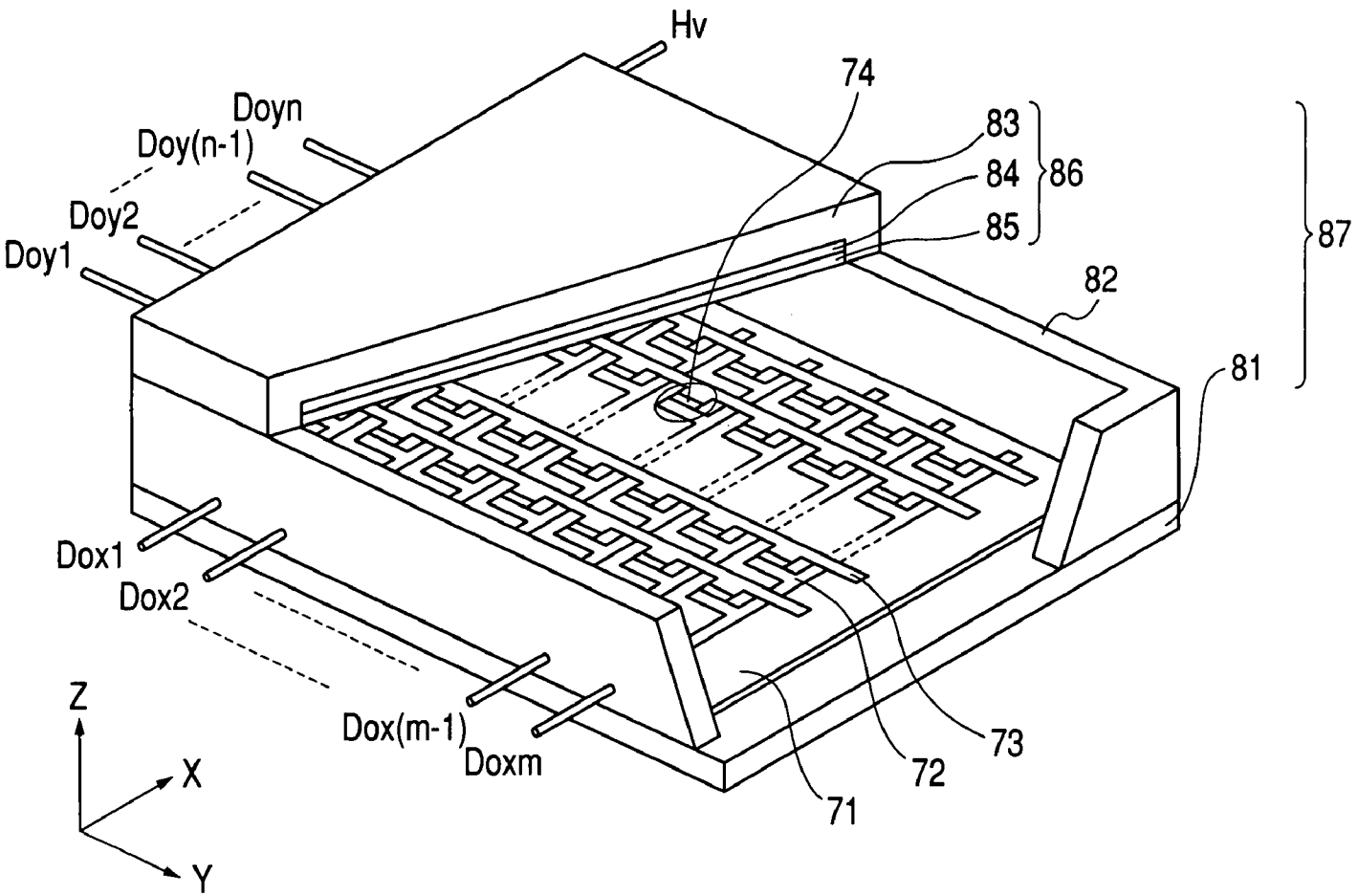
FIG. 8 is a schematic diagram of a display panel according to an embodiment mode of an image display device of the invention.

An image display device, which is constituted using the electron source of such a matrix arrangement, will be explained with reference to FIG. 8. FIG. 8 is a schematic diagram showing an example of the image display device.

In FIG. 8, reference numeral 81 denotes a rear plate to which the electron source substrate 71 is fixed. Reference numeral 86 denotes a face plate in which a fluorescent film (such as a phosphor) 84 and a metal back (an anode electrode) 85, serving as an image display member, and the like are formed on an inner surface of the transparent substarate (such as a glass substrate) 83. Reference numeral 82 denotes a support frame. The rear plate 81 and the face plate 86 are connected to the support frame 82 using an adhesive such as frit glass or indium. Reference numeral 87 denotes an envelope (or a display panel), which is a vacuum container that is constituted by the support frame 82, the rear plate 81, and the face plate 86.

Note that, since the rear plate 81 is provided mainly for the purpose of reinforcing the electron source substrate 71, when the electron source substrate 71 itself has sufficient strength, the separate rear plate 81 can be made unnecessary. In other words, it is also possible to stick the support frame 82 directly on the substrate 71 and constitute the envelope 87 with the face plate 86, the support frame 82, and the substrate 71. On the other hand, it is also possible to constitute the envelope 87 having sufficient strength against the atmospheric pressure by setting a support member (not shown) called a spacer between the face plate 86 and the rear plate 81.

Figure 9A:
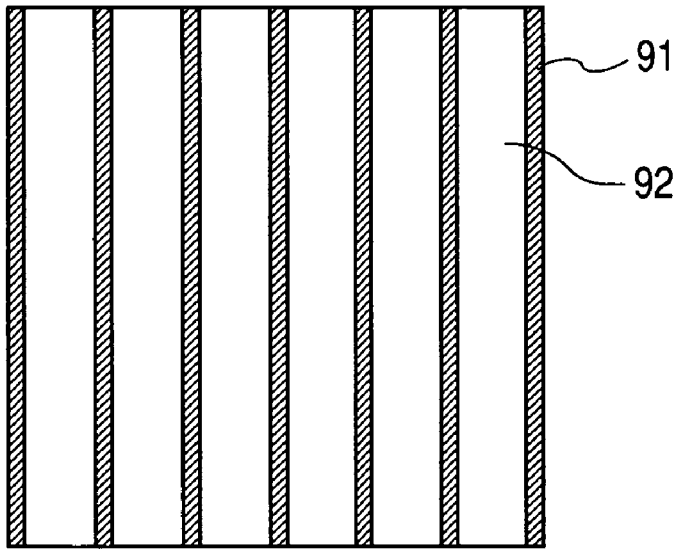
FIGS. 9A and 9B are diagrams showing fluorescent films that are used in the image display device of the invention.
Figure 9B:
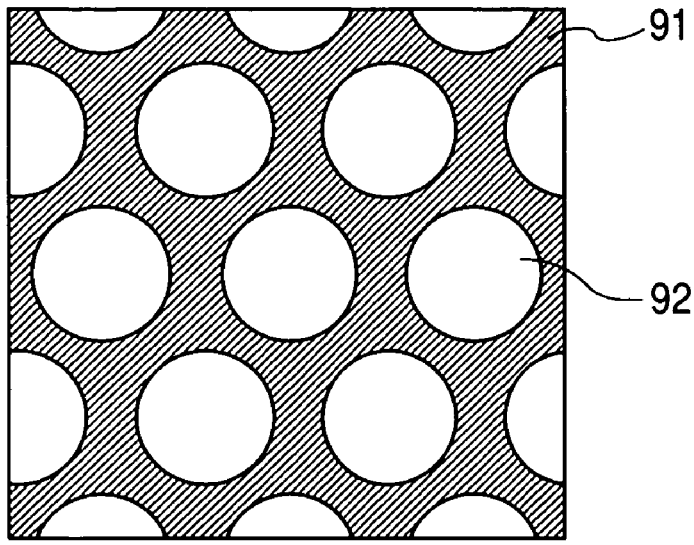

FIGS. 9A and 9B are schematic diagrams showing examples of the fluorescent film 84 that can be used in the image display device of the invention. In the case of a color fluorescent film, it is possible to form the fluorescent film 84 with a black member 91 and phosphors 92 into a so-called black stripe as shown in FIG. 9A or a so-called black matrix as shown in FIG. 9B.

It is possible to constitute an image display and reproduction apparatus using a display panel (the envelope 87) explained with reference to FIG. 8.

More specifically, the information display and reproduction apparatus includes a receiver, which receives a broadcast signal of television broadcasting or the like, and a tuner, which tunes the received signal, and outputs at least one of video information, character information, and audio information included in the tuned signal to a display panel 87 to display and/or reproduce the information on a screen. With this structure, it is possible to constitute an information display and reproduction apparatus such as a television. It is needless to mention that, when a broadcast signal is encoded, the information display and reproduction apparatus of the invention may include a decoder. In addition, the information display and reproduction apparatus outputs an audio signal to audio reproducing means such as a speaker provided separately and reproduces the audio signal in synchronization with the video information and the character information to be displayed on the display panel 87.

As a method of outputting video information or character information to the display panel 87 to display and/or reproduce (play) the video information or the character information on a screen, for example, there is a method as described below. First, image signals corresponding to respective pixels of the display panel 87 are generated from received video information or character information. Then, the generated image signals are inputted to a drive circuit for the display panel 87. A voltage to be applied to respective electron-emitting devices in the display panel 87 from the drive circuit is controlled on the basis of the image signal inputted to the drive circuit to display an image.

Figure 12:
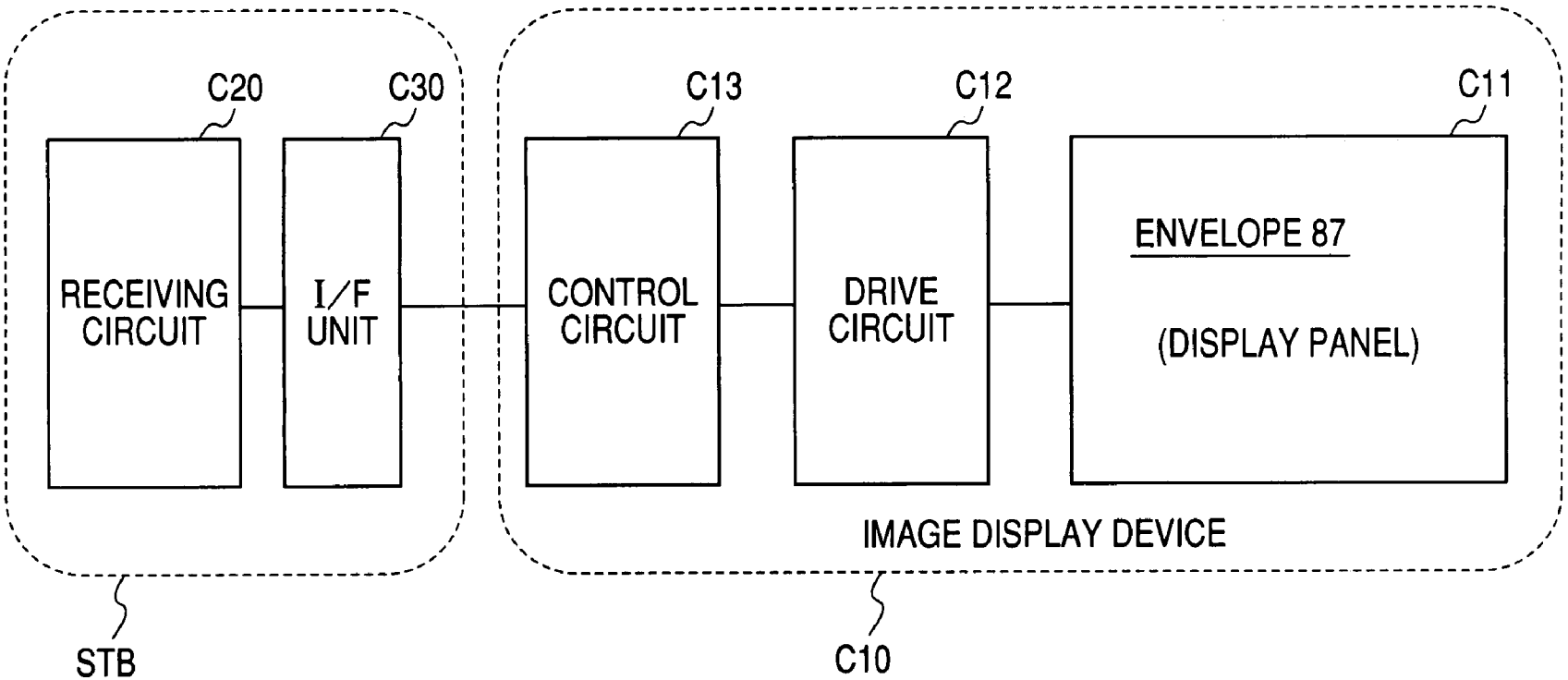
FIG. 12 is a diagram of an example of a structure of an information display and reproduction apparatus using the image display device of the invention.

FIG. 12 is a block diagram of a television apparatus according to the invention. A receiving circuit C20 comprises a tuner, a decoder, and the like. The receiving circuit C20 receives, for example, a television signal of a satellite broadcast, a terrestrial broadcasting such as a terrestrial digital broadcasting, or the like, or a data broadcast via a network and outputs decoded video data to an interface section (an I/F section) C30. The I/F section C30 converts the video data into a display format of the image display device and outputs image data to the display panel C11 (87). The image display device C10 includes the display panel C11 (87), the drive circuit C12, and a control circuit C13. The control circuit C13 applies image processing such as correction processing, which is suitable for the display panel, to the inputted image data and outputs the image data and various control signals to the drive circuit C12. The drive circuit C12 outputs drive signals to respective wirings (Dox1 to Doxm and Doy1 to Doyn in FIGS. 4A and 4B) of the display panel 87 on the basis of the inputted image data, whereby a television video (TV clip) is displayed. The receiving circuit C20 and the I/F section C30 may be housed in a housing separate from the image display device C10 as a set top box (STB) or may be housed in a housing identical with the image display device C10.

Image recording apparatuses and image output apparatuses such as a printer, a digital video cameral, a digital camera, a hard disk drive (HDD), a digital versatile disk (DVD) may be connected to an interface. When such a structure is adopted, it is possible to constitute an information display and reproduction apparatus (or a television) that can display images recorded in the image recording apparatuses on the display panel C11 (87) and process images displayed on the display panel C11 (87) as required and output the images to the image output apparatuses.

The structure of the information display and reproduction apparatus described here is only an example, and various modifications are possible on the basis of the technical idea of the invention. It is possible to constitute various information display and reproduction apparatuses by connecting the information display and reproduction apparatus of the invention to a television conference system and a system such as a computer.

EMBODIMENTS

Embodiments according to this embodiment mode will be hereinafter explained in detail.

First Embodiment

A method of manufacturing an electron-emitting device of this embodiment will be hereinafter explained in detail with reference to FIGS. 10A to 10G.

(Step 1)

Figure 10A:
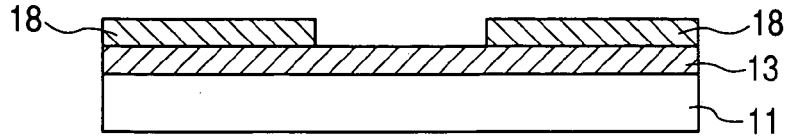
FIGS. 10A, 10B, 10C, 10D, 10E, 10F and 10G are manufacturing process diagrams for an electron-emitting device according to a first embodiment of the invention.

First, as shown in FIG. 10A, a quartz glass was used for the substrate 11 and, after sufficiently cleaning the substrate 11, W with a thickness of 100 nm was deposited on the substrate 11 as the conductive layer 13 by the sputtering method. Subsequently, a positive photoresist was spin-coated on the conductive layer 13 and a photo-mask pattern was exposed and developed to form the mask pattern 18.

The mask pattern 18 was formed excluding a portion to be dry-etched in order to form the cathode electrode 13*c* and the gate electrode 13*g* in the next step. Here, an opening width of the mask pattern 18 was set to 5 μm.

(Step 2)

Figure 10B:
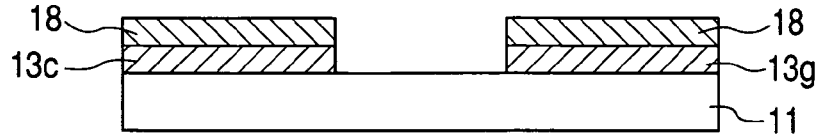

Next, as shown in FIG. 10B, the conductive layer 13 was pierced through by dry etching to separate the conductive layer 13 into two (form a space) and form the cathode electrode 13*c* and the gate electrode 13*g*.

(Step 3)

Figure 10C:
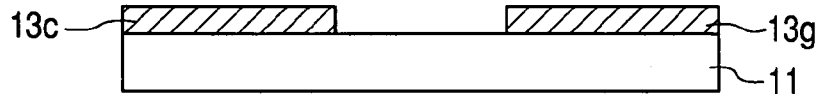

Next, as shown in FIG. 10C, the mask pattern 18 was removed by a removal liquid.

(Step 4)

Figure 10D:
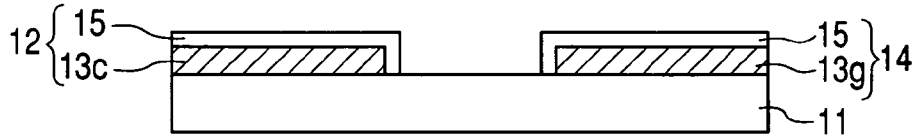

Then, as shown in FIG. 10D, an insulating layer 15 with a dipole layer arranged on a surface thereof was deposited. The deposition of the insulating layer 15 with a dipole layer arranged on a surface thereof was performed in a mixed gas atmosphere of methane and hydrogen by setting a temperature of the substrate to 630° C. and heating the substrate by a lamp for sixty minutes.

(Step 5)

Figure 10E:
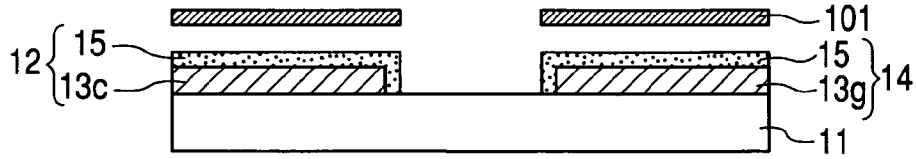

Next, as shown in FIG. 10E, a floating mask 101 was arranged immediately above an electron-emitting electrode 12 and a control electrode 14. The mask 101 had an opening in a portion where the resistive film 16 was arranged between the electron-emitting electrode 12 and the control electrode 14 in the next step.

(Step 6)

Figure 10F:
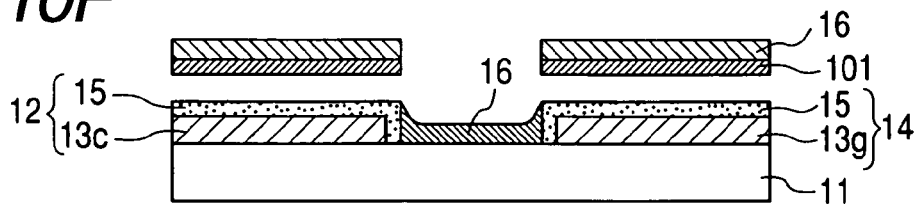

Subsequently, as shown in FIG. 10F, tin oxide with a thickness of 20 nm was deposited as the resistive film 16 on a surface of the substrate exposed between the electron-emitting electrode 12 and the control electrode 14.

The resistive film 16 was formed by an RF magnetron sputtering method. Tin oxide was used as a target. An Ar gas was used as a gas for the RF magnetron sputtering method. The resistive film 16 was formed with an Ar partial pressure of 0.67 Pa and sputtering power of 5 W/cm$^2$. A thickness of the resistive film 16 was controlled according to a sputtering time. A sheet resistance was about $2\times10^{11}$ Ω/□.

(Step 7)

Figure 10G:
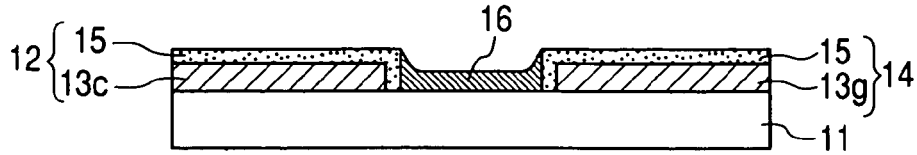

Finally, as shown in FIG. 10G, the floating mask pattern 101 was removed to complete the electron-emitting device.

Note that, in this embodiment, the RF magnetron sputtering method was used as a method of forming the resistive film 16. However, the method of forming the resistive film 16 is not limited to the example described above. The resistive film 16 may be formed by other general vacuum film formation techniques such as the CVD method, the evaporation method, the sputtering method, and the plasma method.

The electron-emitting device manufactured as described above was arranged as shown in FIG. 2 to emit electrons. Here, reference numeral 20 denotes an anode, and reference symbol H denotes an interval between the electron-emitting electrode 12 and the anode 20; Vg, a potential difference between the control electrode 14 and the electron-emitting electrode 12; and Va, a potential difference between the anode 20 and the electron-emitting electrode 12. An electron emitted from the electron-emitting electrode 12 by an electric field formed by Vg is attracted to the anode 20 by an electric field formed by Va.

In this embodiment, the manufactured electron-emitting device was driven with Va of 100 V, Va of 10 kV, and H of 1.6 mm. As a result, abnormal discharge did not occur and stable electron emission characteristics were successfully obtained.

Second Embodiment

FIGS. 11A to 11F are schematic sectional views showing steps of manufacturing the electron-emitting device of this embodiment. In this embodiment, the resistive film 16 was formed by the printing method of the ink jet system. Here, only characteristic parts of this embodiment will be explained, and explanations repeating the explanations of the first embodiment will be omitted.

(Step 1)

Figure 11A:
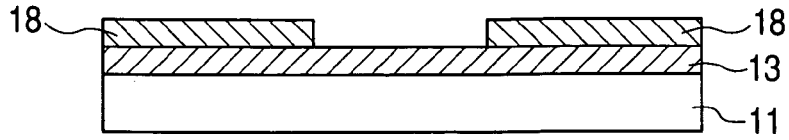
FIGS. 11A, 11B, 11C, 11D, 11E and 11F are manufacturing process diagrams for an electron-emitting device according to a second embodiment of the invention.

First, as shown in FIG. 11A, a quartz glass was used for the substrate 11 and, after sufficiently cleaning the substrate 11, W with a thickness of 100 nm was deposited on the substrate 11 as the conductive layer 13 by the sputtering method. Subsequently, a positive photoresist was spin-coated on the conductive layer 13 and a photo-mask pattern was exposed and developed to form the mask pattern 18. The mask pattern 18 was formed excluding a portion to be dry-etched in order to form the cathode electrode 13*c* and the gate electrode 13*g* in the next step. Here, an opening width of the mask pattern 18 was set to 10 μm.

(Step 2)

Figure 11B:
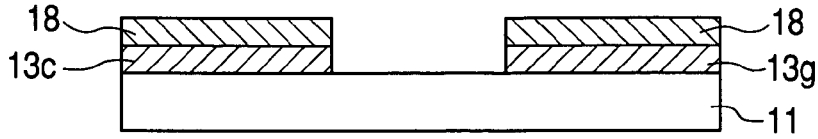

Next, as shown in FIG. 11B, the conductive layer 13 was separated by dry etching to form the cathode electrode 13*c* and the gate electrode 13*g*.

(Step 3)

Figure 11C:
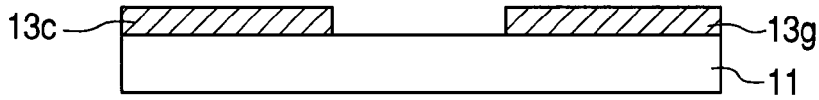

Next, as shown in FIG. 11C, the mask pattern 18 was removed by a removal liquid.

(Step 4)

Figure 11D:
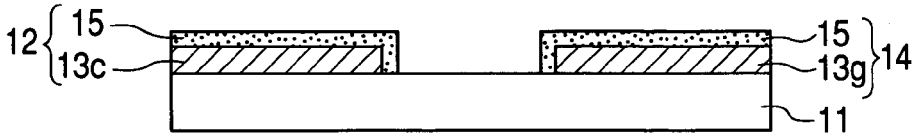

Then, as shown in FIG. 11D, the insulating layer 15 with a dipole layer arranged on a surface thereof was deposited.

The deposition of the insulating layer 15 with a dipole layer arranged on a surface thereof was performed in a mixed gas atmosphere of acetylene and hydrogen by setting a temperature of the substrate to 600° C. and heating the substrate by a lamp for sixty minutes.

(Step 5)

Figure 11E:
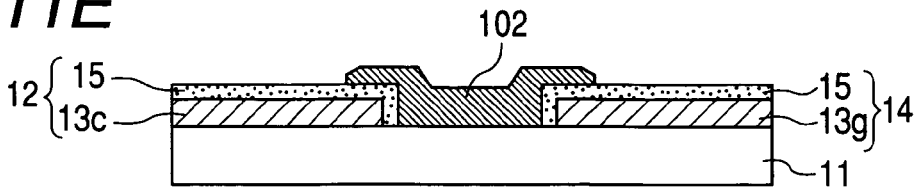

Next, as shown in FIG. 11E, a solution containing graphite was given to the insulating layer 15 using an ink jet apparatus of a bubble jet (registered trademark) system to form a resistive film precursor 102. The solution containing graphite was obtained by adjusting a maximum particle diameter of a water solution (with a graphite concentration of 0.1%) of a graphite dispersed material (with an average particle diameter of 0.1 μm) to 0.3 μm or less with a centrifugal separator.

(Step 6)

Figure 11F:
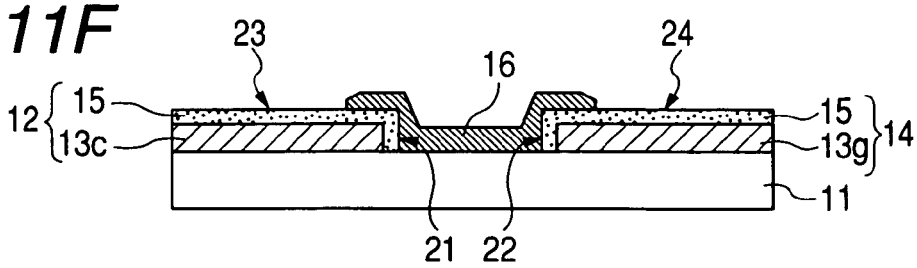

Finally, as shown in FIG. 11F, heat treatment was performed at 200° C. for ten minutes to form the resistive film 16 consisting of graphite particulates and complete the electron-emitting device. A sheet resistance of the resistive film 16 was about $4\times10^7$ Ω/□. Note that, in this embodiment, as shown in FIG. 11F, the resistive film 16 was formed to entirely cover the end 21 of the electron-emitting electrode 12 opposed to the control electrode 14 and the end 22 of the control electrode 14 opposed to the electron-emitting electrode 12 and partially cover the upper surface portions 23 and 24 of the electron-emitting electrode 12 and the control electrode 14.

Note that, in this embodiment, the ink jet apparatus of the bubble jet (registered trademark) system was used to form the resistive film 16. However, a method of forming the resistive film 16 is not limited to the example described above, and the resistive film 16 may be formed by other methods.

As in the first embodiment, the electron-emitting device manufactured as described above was arranged as shown in FIG. 2 to emit electrons. In this embodiment, the manufactured electron-emitting device was driven with Vg of 200 V, Va of 10 kV, and H of 1.6 mm. As a result, abnormal discharge did not occur and stable electron emission characteristics were obtained.

First Comparative Example

When electron emission characteristics of the electron-emitting device manufactured in steps 1 to 4 (steps 5 to 7 were not performed) of the first embodiment were evaluated as in the first embodiment, a fluctuation in an emission current was larger than those in the first and the second embodiments. When the electron-emitting device was driven for a long time, an emission current from the electron-emitting device of this comparative example decreased excessively and, then, was not observed. When a phosphor film was arranged on an anode to observe the electron-emitting devices, a light-emitting area is larger in the electron-emitting device of this embodiment. In addition, a phenomenon of temporal fluctuation in a light-emitting area was observed.

Second Comparative Example

Electron sources and image display devices were manufactured using the electron-emitting devices manufactured in the first and the second embodiments, respectively.

In the respective electron sources, the electron-emitting devices were arranged in a matrix shape of 100×100. As shown in FIG. 7, the X directional wirings 72 (Dx1, Dx2, . . . Dxm) were connected to the electron-emitting electrode 12 and the Y directional wirings 73 (Dy1, Dy2, . . . Dyn) were connected to the control electrode 14. The respective electron-emitting devices 74 were arranged at a horizontal pitch of 205 μm and a vertical pitch of 615 μm. Phosphors were arranged in positions 1.6 mm apart from one another above the electron-emitting devices 74. A voltage of 10 kV was applied to the phosphors. As a result, an image display device was formed, in which matrix drive was possible, abnormal discharge did not occur, and electron emission characteristics were stable.

This application claims priority from Japanese Patent Application Nos. 2004-066555 filed on Mar. 10, 2004 and 2005-027397 filed on Feb. 3, 2005, which are hereby incorporated by reference herein.

What is claimed is:

1. A method of manufacturing an electron-emitting device including an electron-emitting electrode and a control electrode arranged to be spaced apart from each other on a surface of an insulating substrate, the method comprising the steps of:

preparing an insulating substrate having an electron-emitting electrode and a control electrode on the surface thereof; and covering a surface of the insulating substrate, which is located between the electron-emitting electrode and the control electrode, with a resistive film, such that the electron-emitting electrode and the control electrode are connected through the resistive film, wherein the electron-emitting electrode is formed by disposing an electroconductive layer on the surface of the insulating substrate, and by disposing on the electroconductive layer an insulating layer on a surface of which a dipole layer is arranged, and the resistive film is arranged to cover at least an end portion of the surface of the electron-emitting electrode opposed to the control electrode.

2. The method of manufacturing an electron-emitting device according to claim 1, wherein the dipole layer is formed by terminating the insulating layer with hydrogen.

3. The method of manufacturing an electron-emitting device according to claim 2, wherein the insulating layer is formed of a layer containing carbon.

4. A method of manufacturing an electron-emitting device according to claim 1, wherein the resistive film is arranged to cover an end portion of the control electrode opposed to the electron-emitting electrode.

5. A method of manufacturing an electron source having plural electron-emitting devices, wherein the electron-emitting devices are manufactured by the manufacturing method according to claim 1.

6. A method of manufacturing an image display device having an electron source and light-emitting member, wherein the electron source is manufactured by the manufacturing method according to claim 5.

7. A method of manufacturing an electron-emitting device comprising the steps of:

preparing an insulating substrate on a surface of which an electron-emitting electrode having an electroconductive layer and having an insulating layer being disposed on the electroconductive layer, having a surface hydrogen terminated and containing carbon as a main ingredient, and a control electrode are arranged to be spaced apart from each other; and arranging a resistive film to cover an end of the electron-emitting electrode opposing the control electrode and to connect the electron-emitting electrode with the control electrode.

8. A method of manufacturing an electron-emitting device according to claim 7, wherein the resistive film is arranged to cover an end portion of the control electrode opposed to the electron-emitting electrode.

9. A method of manufacturing an electron source having plural electron-emitting devices, wherein the electron-emitting devices are manufactured by the manufacturing method according to claim 7.

10. A method of manufacturing an image display device having an electron source and light-emitting member, wherein the electron source is manufactured by the manufacturing method according to claim 9.

11. An electron-emitting device including an electron-emitting electrode and a control electrode arranged to be spaced apart from each other on a surface of an insulating substrate, wherein a resistive film is arranged, between the electron-emitting electrode and the control electrode, on a surface of the insulating substrate to connect the electron-emitting electrode and the control electrode, wherein the resistive film is arranged to cover at least an end portion of the surface of the electron-emitting electrode opposed to the control electrode, and wherein the electron-emitting electrode comprises a conductive layer stacked on the surface of the insulating substrate, and an insulating layer having a dipole layer on its surface arranged on a surface of the conductive layer.

12. An electron-emitting device according to claim 11, wherein the insulating layer has a surface terminated with hydrogen.

13. An electron-emitting device according to claim 12, wherein the insulating layer is a layer containing carbon.

14. An electron source having plural electron-emitting devices, wherein the electron-emitting devices are the electron-emitting device according to claim 11.

15. An image display device having an electron source and a light-emitting member, wherein the electron source is the electron source according to claim 14.

16. An information display and reproduction apparatus, at least comprising: an image display device that has a screen; a receiver that outputs at least one of video information, character information, and audio information included in a received broadcast signal; and a drive circuit that displays the information outputted from the receiver on the screen of the image display device, wherein the image display device is the image display device according to claim 15.

17. An electron-emitting device including an electron-emitting electrode and a control electrode arranged to be spaced apart from each other on a surface of an insulating substrate, and further including a resistive film arranged to cover at least an end portion of the surface of the electron-emitting electrode opposed to the control electrode and to connect the electron-emitting electrode to the control electrode, and wherein the electron-emitting electrode comprises a conductive layer stacked on the surface of the insulating substrate, and an insulating layer having a surface terminated with hydrogen and containing carbon as a main ingredient.

18. An electron source having plural electron-emitting devices, wherein the electron-emitting devices are the electron-emitting device according to claim 17.

19. An image display device having an electron source and a light-emitting member, wherein the electron source is the electron source according to claim 18.

20. An information display and reproduction apparatus, at least comprising: an image display device that has a screen; a receiver that outputs at least one of video information, character information, and audio information included in a received broadcast signal; and a drive circuit that displays the information outputted from the receiver on the screen of the image display device, wherein the image display device is the image display device according to claim 19.

* * * * *

UNITED STATES PATENT AND TRADEMARK OFFICE

CERTIFICATE OF CORRECTION

PATENT NO. : 7,391,150 B2
APPLICATION NO. : 11/061516
DATED : June 24, 2008
INVENTOR(S) : Kazushi Nomura It is certified that error appears in the above-identified patent and that said Letters Patent is hereby corrected as shown below:

ON THE TITLE PAGE [75]:

Inventor, "Kazushi Nomura, Kanagawa (JP)" should read --Kazushi Nomura, Sagamihara (JP)--.

ON THE TITLE PAGE [57] ABSTRACT:

Line 1, "provide" should read --provides--.

COLUMN 1:

Line 27, "Lai-Open" should read --Laid-Open--.

COLUMN 2:

Line 24, "refer" should read --be referred--.

COLUMN 4:

Line 66, "refered" should read --referred--.

COLUMN 5:

Line 20, "can not to be" should read --can not be--.

COLUMN 7:

Line 41, "contains" should read --contain--.

COLUMN 8:

Line 46, "a potentials" should read --potentials--.

COLUMN 9:

Line 63, "inuslating" should read --insulating--.

UNITED STATES PATENT AND TRADEMARK OFFICE

CERTIFICATE OF CORRECTION

PATENT NO. : 7,391,150 B2
APPLICATION NO. : 11/061516
DATED : June 24, 2008
INVENTOR(S) : Kazushi Nomura It is certified that error appears in the above-identified patent and that said Letters Patent is hereby corrected as shown below:

COLUMN 10:

Line 49, “remodved” should read --removed--.

COLUMN 12:

Line 13, “Each pairs” should read --Each pair--;
Line 15, “are electrically” should read --is electrically--; and
Line 41, “substarate” should read --substrate--.

Signed and Sealed this

Twenty-fifth Day of November, 2008

JON W. DUDAS
*Director of the United States Patent and Trademark Office*